United States Patent [19]

Sumerau

[11] Patent Number: 4,811,452

[45] Date of Patent: Mar. 14, 1989

[54] AUXILIARY ATTACHMENT ADAPTOR AND VACUUM CLEANER FOR USE THEREWITH

[75] Inventor: William R. Sumerau, Easley, S.C.

[73] Assignee: Ryobi Motor Products Corp., Pickens, S.C.

[21] Appl. No.: 147,426

[22] Filed: Jan. 25, 1988

[51] Int. Cl.[4] ..... A47L 5/32

[52] U.S. Cl. ..... 15/337; 15/333

[58] Field of Search ..... 15/332, 333, 337, 334

[56] References Cited

U.S. PATENT DOCUMENTS

| | | | |
|---|---|---|---|
| 1,907,644 | 5/1933 | Fairfax | 15/337 |
| 2,094,126 | 9/1937 | Kitto | 15/333 |
| 2,103,101 | 12/1937 | Taylor | 15/333 |
| 2,126,396 | 8/1938 | Kitto | 15/337 |
| 2,244,132 | 6/1941 | Taylor . | |
| 2,416,418 | 2/1947 | Taylor | 15/332 X |
| 2,668,313 | 2/1954 | Gerber | 15/337 X |
| 2,719,318 | 10/1955 | Tschudy | 15/333 |
| 4,342,132 | 8/1982 | Fromknecht | 15/339 |
| 4,563,790 | 1/1986 | Clark | 15/337 |
| 4,660,246 | 4/1987 | Duncan et al. | 15/329 |

FOREIGN PATENT DOCUMENTS

| | | | |
|---|---|---|---|
| 1173013 | 12/1969 | United Kingdom | 15/333 |

*Primary Examiner*—Chris K. Moore

*Attorney, Agent, or Firm*—David L. Davis

[57] ABSTRACT

A vacuum cleaner is provided for use with an improved adaptor for associating auxiliary cleaning attachments with the cleaner. Insertion of the improved adaptor into an auxiliary suction port of the vacuum cleaner may be used to actuate various mechanisms internal to the vacuum cleaner. Such mechanisms include a pivoting lift bar situated on a lower side of the vacuum cleaner chassis, for lifting a main vacuum nozzle and rotating beater bar brush from a floor on which the vacuum cleaner is supported. Such lifting disengages the rotating beater bar brush from the floor while the vacuum cleaner performs auxiliary attachment cleaning. A pivoting diverter door may also, or in the alternative, be actuated upon insertion of the improved adaptor into the vacuum cleaner auxiliary suction port, for diverting suction power from a main suction nozzle through the adaptor and into an auxiliary cleaning attachment such as a hose associated with the adaptor. The improved adaptor includes various camming structures for performing such actuations preferably upon insertion and subsequent rotation of the improved adaptor in the auxiliary suction port. Engagement surfaces and guide elements of both the adaptor and vacuum cleaner facilitate axial rotation and securement of the adaptor in the auxiliary suction port.

21 Claims, 5 Drawing Sheets

AUXILIARY ATTACHMENT ADAPTOR AND VACUUM CLEANER FOR USE THEREWITH

BACKGROUND OF THE INVENTION

This invention concerns in general an adaptor for attaching auxiliary cleaning attachments to a vacuum cleaner, as well as a vacuum cleaner constructed for use with such an adaptor. The invention more particularly concerns an adaptor having camming structure for automatically actuating one or more various mechanisms of a vacuum cleaner upon securement of the adaptor in an auxiliary suction port of the cleaner.

In general, it is well known for vacuum cleaners which have a main suction nozzle or port to be constructed for alternative use with auxiliary cleaning attachments. Auxiliary attachments, such as flexible hoses with various cleaning heads attached thereto, may be secured in auxiliary suction ports incorporated into a variety of styles of vacuum cleaners. Upright and canister styles are several examples of such vacuum cleaners.

U.S. Pat. No. 4,660,246 (Duncan et al., commonly assigned with the present application) discloses an example of a convertible vacuum cleaner adapted for receiving an auxiliary cleaning attachment adaptor 112 in an auxiliary suction opening 110 thereof. The vacuum cleaner is convertible between upright and hand-held styles, with auxiliary cleaning available in either such configuration. The insertable adaptor of the above-mentioned Duncan et al. patent has a flange which, when fully inserted into opening 110, blocks off suction from a main nozzle so that air will be drawn through a flexible hose associated with the adaptor.

While the Duncan et al. adaptor more particularly concerns the diversion of suction power into an associated auxiliary cleaning attachment, some vacuum cleaners generally address other facets of adapting to auxiliary cleaning modes. For example, particularly in permanent or convertible upright style vacuum cleaners, it is well known to provide a main suction nozzle on a lower side of the vacuum cleaner which faces a floor surface on which the vacuum cleaner is supported (and which floor surface is to be cleaned). It is also known to incorporate a rotating beater bar brush in or adjacent to such main suction nozzle. During auxiliary cleaning with such vacuum cleaners incorporating rotating brushes, often the brush is either allowed to continue rotating or is variously disengaged from the floor surface so as to better accommodate the auxiliary cleaning mode.

Disengagement may be accomplished by variously stopping rotation of the brush or generally by raising a portion of the vacuum cleaner chassis so that the brush no longer contacts the supporting floor surface even while the brush may continue to rotate. Such chassis raising is typically accomplished by movement of the vacuum cleaner handle into a particular placement (such as a full upright position thereof), which through cables and linkages pulls a portion of the chassis upward from the supporting floor surface.

It is also generally known to adjust the desired height of a main suction nozzle and/or rotating beater bar brush relative a floor surface to be cleaned. U.S. Pat. Nos. 4,342,132 (issued to Fromknecht, commonly assigned with the present application) and 2,244,132 (issued to Taylor) disclose examples of such vacuum cleaners for adjusting the cleaner head height for various carpet pile thicknesses. Neither such patent is particularly concerned however with adjusting chassis height for auxiliary cleaning modes, or so that a rotating beater bar brush is fully disengaged from a floor surface for continued rotation of such bar brush during auxiliary cleaning operation.

SUMMARY OF THE INVENTION

Broadly stated, this invention addresses aspects of converting a vacuum cleaner for auxiliary cleaning with auxiliary cleaning attachments. Hence, it is a general object of the present invention to provide an improved adaptor for associating auxiliary cleaning attachments with a vacuum cleaner, as well as an improved vacuum cleaner for use with such an adaptor, and a combination of such a vacuum cleaner and adaptor as comprising an improved vacuum cleaner system.

It is a more particular object of the present invention to provide an improved adaptor for auxiliary cleaning attachments so that the vacuum cleaner with which it is used is automatically converted for auxiliary cleaning operations responsive to insertion and rotation of such improved adaptor therein. It is yet a more particular object to provide such an improved adaptor which includes camming means for actuating various mechanisms of a vacuum cleaner into which it is inserted, so as to either divert suction force of the vacuum cleaner to auxiliary cleaning attachments associated with the adaptor, or so as to lift the vacuum cleaner chassis to disengage a main suction nozzle and/or rotating beater bar brush thereof from a support surface thereunder, or both.

It is another more general object of the present invention to provide an improved vacuum cleaner for alternative use with auxiliary cleaning attachments. A more particular object is to provide such a vacuum cleaner adapted for automatically diverting suction force to such attachments when inserted therein with a particular adaptor, and for alternatively further automatically lifting a main suction nozzle and driven bar brush journaled therein relative a work surface so as to permit continued rotation of such bar brush even during auxiliary cleaning operations. Another object is to provide an improved vacuum cleaner with features and structure internal thereto for being actuated by insertion and rotation of an auxiliary cleaning attachment adaptor therein, for effecting either one or both of the above-mentioned automatic lifting or diverting features.

It is still another general object of the present invention to provide an improved vacuum cleaner system for alternately operating for main or auxiliary cleaning by supplying vacuum power to a main vacuum nozzle thereof or to an auxiliary attachment secured thereto, respectively. A further object is to provide such an improved vacuum cleaner system which is responsive to association of an auxiliary cleaning attachment therewith for automatically assuming a configuration for auxiliary cleaning operation, including automatically overriding any existing pile height setting of a variable pile height feature thereof otherwise operable during main cleaning operations.

Various features and aspects of an improved adaptor, vacuum cleaner, and vacuum cleaner system are disclosed herewith in keeping with the foregoing objects, and other objects and purposes which will be self-evident from the remaining disclosure. Different embodiments in accordance with this invention may incorporate different combinations of such features and aspects, as well as combinations including substitutions of various equivalent features and structures therefor, as will be known to those of ordinary skill in the art. Furthermore, various combinations of features of this invention and their equivalents may be practiced by those of ordinary skill in the art in satisfaction of particular design and environment constraints. All such combinations are intended to fall within the spirit and scope of this invention, notwithstanding the fact that various of such combinations may not be expressly recited hereinafter.

One exemplary embodiment in accordance with the present invention is directed to a vacuum cleaner adapted for use with auxiliary cleaning attachments, comprising a main chassis having a main suction nozzle, a dirt collecting bag, a vacuum channel for interconnecting such main suction nozzle with the dirt collecting bag, suction motor means for providing suction force in the vacuum channel and directed towards the dirt collecting bag, an auxiliary suction port adapted for receipt and securement therein of an auxiliary cleaning attachment, and diverter means adjacent the vacuum channel and operatively associated with the auxiliary suction port for automatically diverting suction force provided in the vacuum channel from the main suction nozzle to the auxiliary suction port upon receipt and securement of an auxiliary cleaning attachment therein, whereby the vacuum cleaner is adapted to automatically apply suction force to an auxiliary cleaning attachment inserted therein instead of the main vacuum nozzle thereof for auxiliary cleaning with such attachment.

Yet another exemplary vacuum cleaner embodiment in accordance with the present invention includes lift means and lift actuation means in place of, or further in combination with, the foregoing diverter means. Such alternative, or further combined, features may comprise lift means situated intermediate a main suction nozzle and wheel means on a chassis lower side for controllably lifting such main suction nozzle, upon selected actuation of such lift means, by pivoting the chassis upward about the wheel means thereof, and further comprise lift actuation means operatively associated with the lift means and an auxiliary suction port for responding to receipt and securement of an auxiliary cleaning attachment therein by actuating such lift means for effecting the lifting operation thereof. With such embodiment, the vacuum cleaner is adapted to automatically lift its main suction nozzle and a driven bar brush journaled therein relative a work surface upon which the vacuum cleaner lower side is supported whenever an auxiliary cleaning attachment for auxiliary cleaning with such attachment is inserted therein.

Yet another exemplary embodiment incorporating features of the present invention concerns an improved adaptor for permitting use of an auxiliary cleaning attachment with the vacuum cleaner. Such adaptor preferably comprises a generally hollow, cylindrical body having a first substantially open end thereof adapted for operative securement of an auxiliary cleaning attachment thereto, and a second open end opposite from the first end thereof and adapted for operative securement in an auxiliary suction port of a vacuum cleaner. The second end includes an extended flange adapted for guided insertion thereof into the vacuum cleaner port and subsequent rotation of the adaptor about its axial axis. Such extended flange may further define one or both of a pair of respective camming means thereon for actuating the vacuum cleaner upon insertion and rotation of the adaptor therein, so as to divert suction force of the vacuum cleaner through the adaptor hollow body to an auxiliary cleaning attachment secured to the first end thereof, and so as to lift a main suction nozzle and rotating beater bar brush of the vacuum cleaner from a support surface thereunder, respectively, whereby the vacuum cleaner is automatically converted for auxiliary cleaning operations with auxiliary cleaning attachments upon insertion and rotation of the improved adaptor therein.

The present invention also concerns various combinations of features directed to a vacuum cleaner system for alternately operating for main or auxiliary cleaning by supplying vacuum power to a main vacuum nozzle thereof or to an auxiliary attachment secured thereto, respectively. One exemplary such vacuum cleaner system comprises a main chassis including a head portion having for main cleaning operation a main vacuum nozzle on a lower side thereof, and including a body portion having a dirt collecting bag; a rotating bar brush journaled in the main vacuum nozzle; vacuum channel means, defined within the chassis, for interconnecting the main vacuum nozzle with the dirt collecting bag; suction means, carried on the chassis, for providing suction force within the vacuum channel means directed towards the dirt collecting bag; an auxiliary suction port defined in the chassis through an outer wall thereof, for providing auxiliary access to the vacuum channel means; and an access door, supported on the chassis outer wall, for selectively covering the auxiliary suction port.

A vacuum cleaner system such as the foregoing may in accordance with this invention further include combined therewith lift means, operatively associated with the auxiliary suction port and the chassis lower side, and responsive to selected actuation thereof for lifting the bar brush away from a floor surface on which the chassis lower side is supported by an amount adequate to fully disengage the rotating bar brush from such floor surface; an auxiliary attachment for auxiliary cleaning operation therewith; and adaptor means, mounted on one end of the auxiliary attachment, for selected securement thereof in the auxiliary suction port uncovered by the access door for operatively interconnecting the auxiliary attachment with the vacuum channel means so as to conduct vacuum force through such auxiliary attachment for auxiliary cleaning therewith remote from the main vacuum nozzle, and further for actuating the lift means upon securement of the adaptor means in the auxiliary suction port. Such a vacuum cleaner system is automatically converted for auxiliary cleaning operation upon association of an auxiliary attachment with the main chassis thereof by the lifting and resulting floor surface disengagement of the rotating bar brush.

Additional embodiments of vacuum cleaner systems in accordance with the present invention may include diverter means in place of, or further in combination with, the foregoing lift means. Such diverter means may be defined on the main chassis and operatively associated with the auxiliary suction port and the vacuum channel means thereof, and responsive to selected actuation thereof for diverting suction force within the vacuum channel means from the main vacuum nozzle to an auxiliary suction port. As understood by those of ordinary skill in the art, the foregoing adaptor means may be modified in accordance with the present invention for actuation of such diverter means (when present) upon securement of the adaptor means in an auxiliary suction port.

Various further objects, features and embodiments pertaining to the present invention will be understood from the remaining description and disclosure.

BRIEF DESCRIPTION OF THE DRAWINGS

A full and enabling disclosure of the present invention, including the best mode thereof, is set forth more particularly in the remaining portion of the specification, together with reference to the accompanying drawings, in which.

Figure 1:
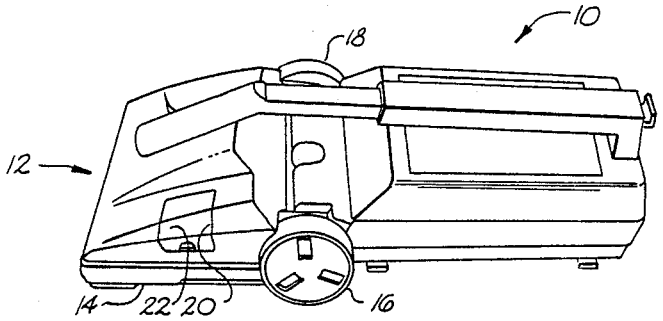
FIG. 1 is a side perspective view of an exemplary vacuum cleaner with which the present invention may be practiced, illustrating the location of an auxiliary suction port thereof.

Repeat use of reference characters throughout the present specification and accompanying drawings is intended to represent same or analogous features or elements of this invention.

DETAILED DESCRIPTION OF THE PREFERRED EMBODIMENTS

It should be understood that various aspects and features of the present invention may be applied to and practiced with different types of vacuum cleaner constructions for providing same with auxiliary cleaning operation, or improving such operation. For present disclosure purposes, features of this invention are illustrated and discussed in conjunction with a convertible upright style vacuum cleaner, such as generally disclosed in Duncan et al. (U.S. Pat. No. 4,660,246), the disclosure of which is incorporated herein by reference, particularly as regards non-essential features of the present invention more generally relating to vacuuming operations.

FIG. 1 illustrates a convertible vacuum cleaner 10 generally constructed as that disclosed in the above-cited Duncan et al. patent, though differing therefrom with respect to various actuatable mechanisms and features to which the present invention is more particularly directed. In general, vacuum cleaner 10 includes a main chassis 12 having a lower side thereof 14 supported at least in part on a pair of wheels 16 and 18. A main suction nozzle situated on chassis lower side 14 is provided for use during main suctioning or cleaning operations under suction force provided with suction means (not illustrated), all as well known to those of ordinary skill in the art.

An auxiliary suction port 20, removably covered by an access cover 22, permits vacuum cleaner 10 to operate for auxiliary cleaning with auxiliary cleaning attachments selectively associated with port 20 (preferably through means of an adaptor). Vacuum cleaner 10, together with such auxiliary attachments, and an adaptor for fitting such attachments to port 20 (discussed below in greater detail) comprise an improved vacuum cleaner system in accordance with the present invention.

Figure 2:
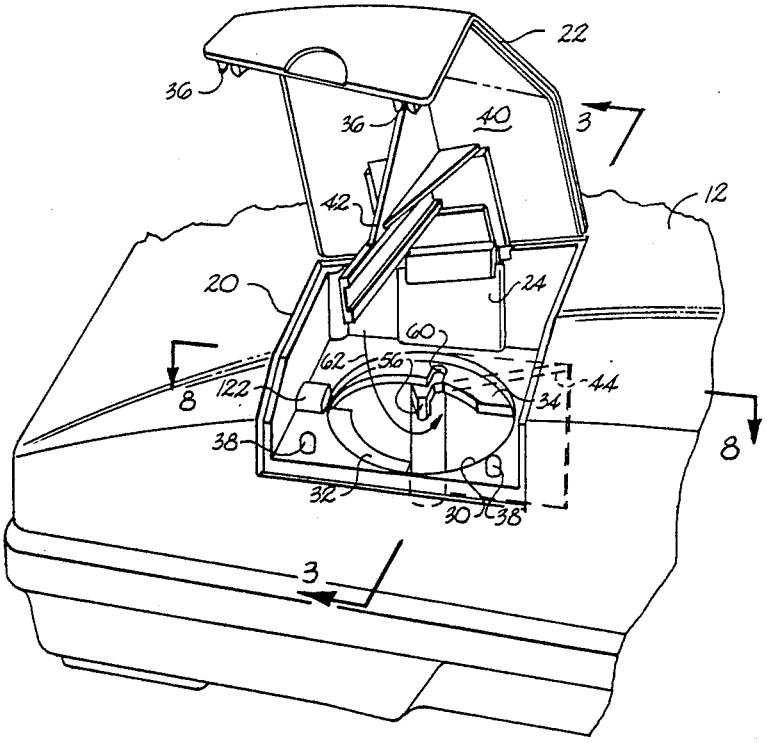
FIG. 2 is an enlarged view of an exemplary auxiliary suction port area of the vacuum cleaner of FIG. 1, with an access cover thereof at least partially opened to reveal details of such cover and port.
Figure 3:
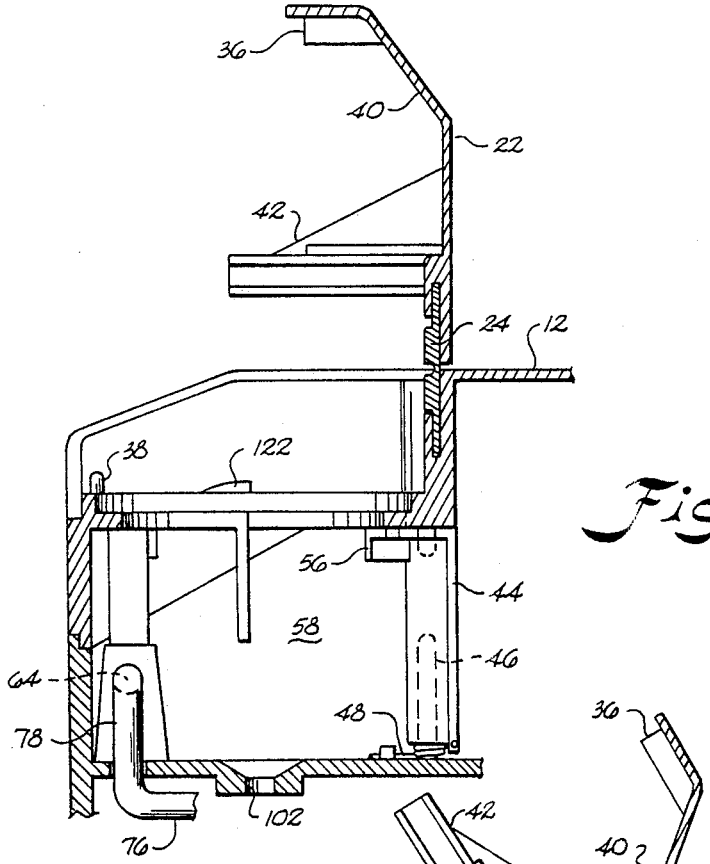
FIG. 3 is a sectional view of the FIG. 2 illustration of an auxiliary suction port area, taken along the line 3—3 illustrated therein.
Figure 4:
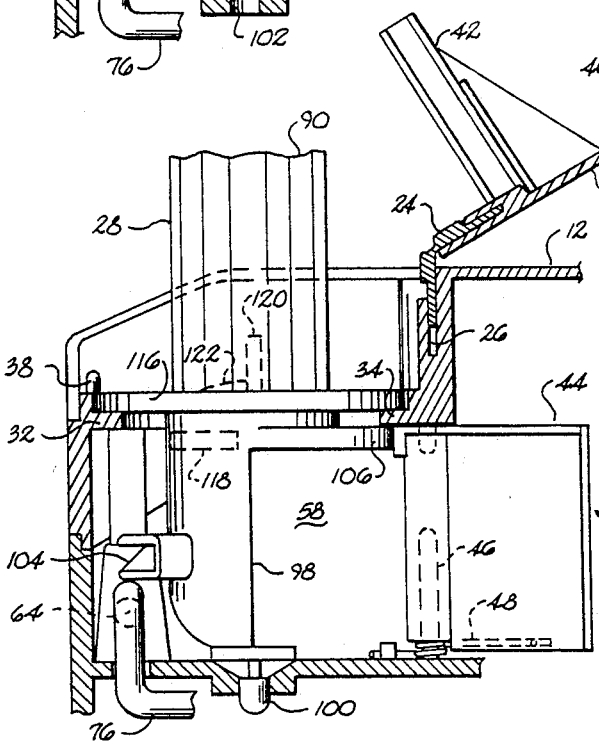
FIG. 4 is a sectional view similar to that of FIG. 3, with the access cover thereof more fully opened and with an exemplary auxiliary cleaning attachment adaptor received therein.

FIGS. 2–4 illustrate in greater detail auxiliary suction port 20 and removable access cover 22 therefor. When closed as illustrated in present FIG. 1, cover 22 does not permit access to auxiliary suction port 20. However, when opened as illustrated in various degrees in present FIGS. 2–4, cover 22 permits introduction of an adaptor (see especially FIG. 4) for operatively associating an auxiliary cleaning attachment such as a flexible hose with vacuum cleaner 10 for auxiliary cleaning operations.

In particular, cover 22 preferably is pivotably mounted relative chassis 12. In the presently preferred embodiment, such mounting comprises a "live hinge" 24 which permits rotation about such hinge up to as much as 180°. As illustrated in FIG. 4, such hinge construction 24 (which slides up and down within a channel 26 to selectively re-position the pivot axis of cover 22) permits selective opening of cover 22 by an amount adequate for the introduction of an adaptor 28 into auxiliary suction port 20 without any interference with such cover. Such adaptor introduction, provided in accordance with features of the present invention, actuates one or more mechanisms of vacuum cleaner 10, which actuation or actuations serve to advantageously adapt (i.e., convert) a vacuum cleaner in accordance with this invention for auxiliary cleaning operation therewith.

Auxiliary suction port 20 includes a portal defined through an exterior side wall (i.e., top cover) of chassis 12, and an opening 30 having a predetermined circumferential configuration (e.g., see present FIG. 2). Such configuration for opening 30 includes axially inward projections or surfaces 32 and 34, which serve to variously contribute to reception, guidance, and securement of an adaptor 28 within opening 30 for auxiliary cleaning operations. Such insertion and securement of an adaptor within opening 30 may assume various forms, but preferably includes properly oriented axial insertion of adaptor 28 in the auxiliary suction port and subsequent axial rotation of the adaptor about its longitudinal axis. Such insertion and subsequent rotation effects various actuations for adapting vacuum cleaner 10 for auxiliary cleaning operations, as discussed further hereinbelow.

When cover 22 is closed, a pair of receptacles 36 integrally formed with or otherwise associated with such cover may respectively cooperate with a pair of projections 38 defined adjacent opening 30 for a snap-lock fit of cover 22 thereover. Alternatives may be practiced for selected closure of cover 22, but various positive locking engagements or their equivalents are preferred to ensure the operator of proper closure, and to minimize any potential noise due to vibration of an otherwise unsealed cover.

When closed, an interior side 40 of cover 22 may alternatively include a projecting wing-like structure 42, comprising a locking means for a pivotally mounted door 44 mounted within chassis 12. As also illustrated by the top elevational views of present FIGS. 8 and 9, door 44 is preferably pivotably mounted about an upright post 46, and further preferably spring mounted thereabout with a spring 48 near the base of post 46 so that door 44 is generally biased towards a closed position thereof (as illustrated in present FIG. 8). FIG. 9 illustrates a defined open position of pivoting door 44.

Figure 8:
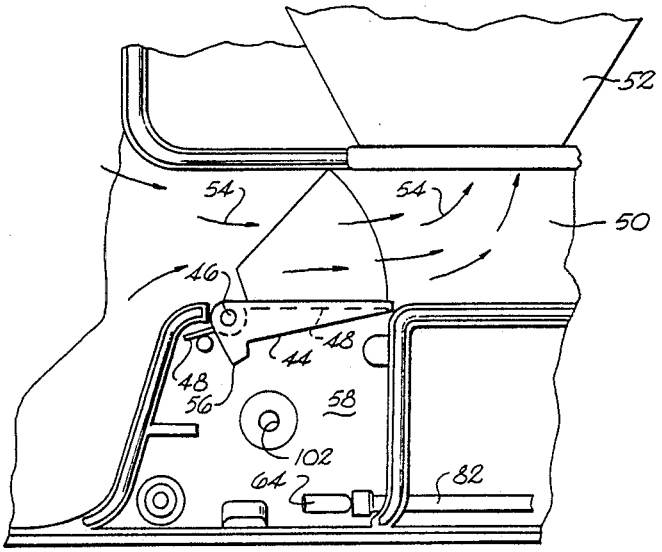
FIGS. 8 and 9 illustrate top elevational views of an exemplary auxiliary suction port section of a vacuum cleaner such as in present FIG. 1, without and with an adaptor inserted therein, respectively, and with the chassis outer cover removed for illustration of internal vacuum cleaner mechanisms responsive to introduction of the improved adaptor for diverting suction force from a main suction nozzle to an auxiliary suction attachment associated with such adaptor.
Figure 9:
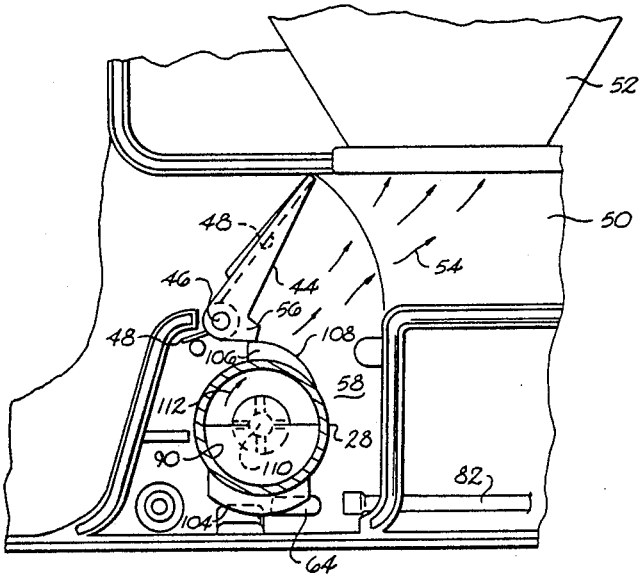
Figure 10:
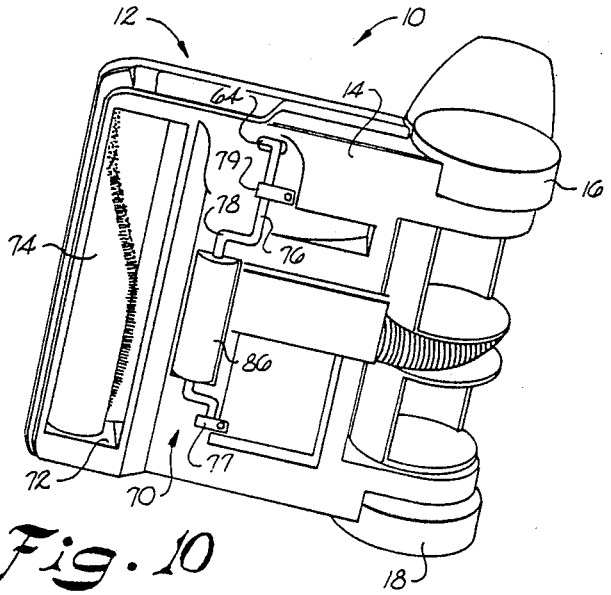
FIG. 10 illustrates a perspective view of a chassis lower side for a vacuum cleaner similar to that of present FIG. 1 (converted to an upright configuration thereof) for illustrating lift means features of the present invention.

When closed as illustrated in present FIG. 8, door 44 defines a common side wall between a vacuum channel or vacuum channel means 50, and the auxiliary suction port. Suction motor means 52 provides suction force 54 within suction channel means 50. The pivoting structure more particularly illustrated in present FIGS. 2–4, 8, and 9, comprises diverter means adjacent vacuum channel 50 and operatively associated with auxiliary suction port 20 for automatically diverting suction force 54 provided in vacuum channel 50 from a main suction nozzle (discussed below) to the auxiliary suction port upon actuation of such diverter means by receipt and securement of an auxiliary cleaning attachment adaptor 28 therein (FIGS. 4 and 9). For accomplishing such actuation, pivoting door 44 preferably includes a relatively rigid finger member 56 projecting therefrom and into the vicinity of the auxiliary suction port for being actuated by a camming structure associated with adaptor 28 (as discussed further hereinbelow).

In general, such member 56 comprises a first relatively rigid extension finger fixedly attached to diverter door 44 and projecting therefrom at least partially into an auxiliary suction portal internal chamber 58. Selected movement of first finger 56 from the position thereof illustrated in FIG. 8 to the position thereof illustrated in present FIG. 9 actuates diverter door 44 so as to overcome the spring biasing thereof for moving the diverter door into its opened position, which results in diverting suction force 54 from main cleaning operation to auxiliary cleaning operation, as discussed above. Adaptor structure for such diverter door actuation is discussed below in detail.

As also illustrated in present FIGS. 2–4, locking means 42 associated with access cover 22 engages first projection finger 56 whenever such access door 22 is closed. Such engagement secures pivoting door 44 in the closed position (FIG. 8) thereof. Whenever door 22 is pivoted to its closed position, locking means 42 projects generally downward through a slit 60 within opening member 34 so as to engage first projecting finger 56, as suggested by arrow 62. Hence, locking means 42 may be alternatively provided to supplement the spring biasing of door 44, for preventing same from being partially opened by suction force 54 within vacuum channel 50 during main cleaning operation of the vacuum cleaner 10. Obviously, even slight leaks around the free edge of door 44 would result in corresponding diminution of suction force at the main suction nozzle. Practice of the locking means 42 feature of the present invention ensures that diverter means within the vacuum cleaner will remain closed during main cleaning operations, for application of maximized vacuum power to the main suction nozzle.

As illustrated more particularly in present FIGS. 3, 4, and 6–9, a second relatively rigid extension finger 64 projects at least partially into auxiliary suction portal internal chamber 58. Selected movement of second finger 64 is accomplished upon insertion and subsequent rotation of an adaptor 28 within the auxiliary suction port, whenever adaptor 28 is provided with particular camming structure as discussed below. Finger 64, as discussed more particularly below, concerns a lift actuation means which actuates lift means (generally indicated by reference character 70) for lifting a main vacuum nozzle and rotating beater bar brush associated therewith on a chassis lower side 14 away from a floor surface upon which such main chassis is supported.

With reference to FIGS. 4 and 6–12, a main suction nozzle 72 is illustrated with a rotating beater bar brush 74 situated therein (rotatably driven as understood by those of ordinary skill in the art without further explanation). As well known, the purpose of rotating bar brush 74 is to engage or agitate a floor surface to be cleaned with main suction nozzle 72. The height of bar brush 74 relative a floor surface to be cleaned may be adjusted by manipulation of pivoting lift bar 76 which has an angled portion 78. Upon rotation of bar 76 within capture elements 77 and 79, portion 78 extends outwardly away from chassis lower side 14 so as to pivot such chassis main suction nozzle about the axis 80 of support wheels 16 and 18. Preferably, angled lift bar 76 comprises a relatively rigid member, integrally incorporating thereinto second extension finger 64. Hence, as finger 64 is actuated, bar 76 is rotated for projecting portion 78 thereof.

FIGS. 6–9 illustrate in particular a push bar or equivalent mechanism 82 which may be used to actuate lift means 74 via finger 64 for desired positioning of main suction nozzle 72 and/or beater bar brush 74 relative floor surface 84. As referred to in the Background section, supra, such adjustment may be desired to accommodate varying carpet pile heights. Carpet pile height adjustment is of more particular importance during main cleaning operations (i.e., vacuuming through a main suction nozzle).

It is a more particular feature of the present invention that association of an adaptor 28 with an auxiliary suction port of vacuum cleaner 10 to convert cleaner 10 for auxiliary cleaning may be used to actuate second finger 64, and hence override any position setting of push rod 82 so that main suction nozzle 72 and rotating beater bar brush 74 are completely disengaged from floor surface 84 during auxiliary cleaning operations. Projecting or angled portion 78 of angled lift bar 76 preferably includes a roller means 86 or its equivalent to further facilitate mobile support of vacuum cleaner 10 with wheels 16 and 18 thereof during either main or auxiliary cleaning operations.

The foregoing description generally pertains to internalized structure or mechanisms of a vacuum cleaner 10 in accordance with the present invention, constructed for receiving and being responsive to an auxiliary cleaning attachment adaptor for automatically converting for auxiliary cleaning operations. In accordance with this invention, such a vacuum cleaner may be actuated by insertion of the adaptor for accomplishing one or both of two separate functions: (a) fully disengaging main suction nozzle 72 and/or rotating beater bar brush 74 thereof from floor surface 84, and (b) diverting suction force 54 from main suction nozzle 72 to an auxiliary cleaning attachment associated with such vacuum cleaner via the adaptor. The remaining disclosure more particularly pertains to adaptor means for operatively associating an auxiliary cleaning attachment (e.g., such as a flexible hose) with such a vacuum cleaner generally as discussed above.

Figure 5:
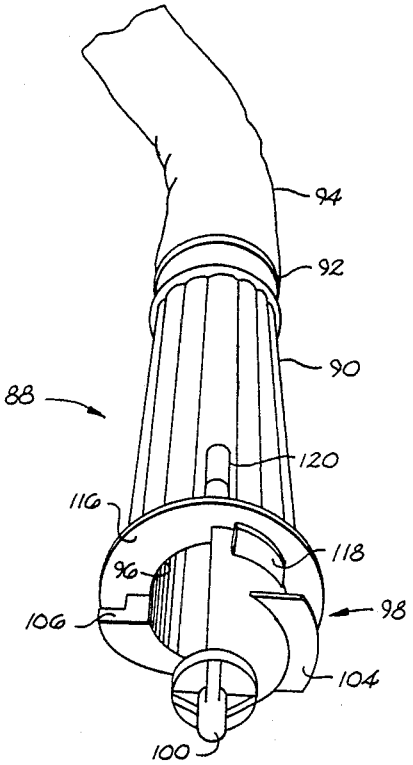
FIG. 5 is a plan, slightly-elevated end view of an exemplary adaptor in accordance with this invention, similar to that shown in present FIG. 4, and further associated with an auxiliary cleaning hose.

FIG. 5 illustrates a slightly-elevated end plan view of an exemplary adaptor means 88 in accordance with the present invention. With reference to FIGS. 4–7, 9, and 12, adaptor means 88 is described more particularly as follows.

A generally hollow, cylindrical body 90 includes a first substantially open end 92 adapted for operative securement of an auxiliary cleaning attachment 94 (such as a flexible hose) thereto. A second substantially open end 96 is provided opposite first end 92. Second end 96 is preferably adapted for operative securement in auxiliary suction port 20 of vacuum cleaner 10.

More particularly, second end 96 includes an extended flange region 98, preferably of generally semi-circular construction (as illustrated by the various views) and adapted for insertion into auxiliary suction portal internal chamber 58 through opening 30. An axial rotation axis 110 (see FIG. 9) is defined longitudinally along the center of generally cylindrical body 90. An extended axial end 100 of body 90 is in co-axial alignment with such rotation axis 110 for defining a rotation tip or rotational guide element for adaptor means 88. Main chassis 12 further defines therein, generally beneath opening 30 at the bottom of internal chamber 58, a rotation guidance opening 102 for receipt of the rotational guide element (i.e. axial end 100), whereby guided axial rotation of adaptor means 88 within auxiliary suction port 20 is advantageously accomplished.

Extended flange region 98 further integrally defines, or at least fixedly supports thereon, camming structure, and with which various diverter and/or lift means discussed above may be automatically actuated upon association of adaptor means 88 with a given vacuum cleaner adapted for receiving same in an auxiliary suction port thereof. While the present illustrations reflect a preferred embodiment having a pair of such camming structures 104 and 106, given embodiments in accordance with the present invention may selectively include either one or both of such camming structures.

Camming structures 104 and 106 comprise camming means for actuating the above-described lift means and diverter means, respectively, of the present invention. In other words, guided insertion of adaptor means 88 into an auxiliary suction port 20 and subsequent rotation thereof causes camming means 104 to actuate projecting finger 64 of the lift actuation means, which in turn causes lift means 70 to disengage main suction nozzle 72 and/or rotating beater bar brush 74 from lower support surface 84. With respect to diverter means, such adaptor means insertion and subsequent rotation causes camming means 106 to engage and actuate extension finger 56 for overcoming spring biasing 48 of pivoting door 44 and moving same from its closed position (FIG. 8) to its opened position (FIG. 9) for diverting suction force into auxiliary cleaning hose 94 through the hollow, cylindrical body 90 of adaptor means 88. Different relatively rigid materials may be used for adaptor means 88 to facilitate the foregoing operation thereof, with high impact plastic materials forming one example thereof.

While various constructions may be provided in accordance with the present invention, preferably the respective camming means defined by adaptor means 88 provide respective actuation forces parallel to and perpendicular to the axial rotation axis 110 of cylindrical body 90. For example, the progressively increasing outer diameter of camming means 106 (see for example curved surface 108 of present FIG. 9) causes an actuation force to act perpendicular to rotational axis 110 of cylindrical member 90 as such member is inserted and subsequently rotated in the direction of arrow 112 (i.e., clockwise). On the other hand, the downwardly facing curvature of leading edge 114 of camming means 104 (see FIGS. 6 and 7) generally provides an actuation force which acts parallel to rotational axis 110 of body 90 as such body is rotated clockwise, resulting in the pivoting of the lift actuation means and lift means as more particularly illustrated in the figures, and as discussed above.

Figure 6:
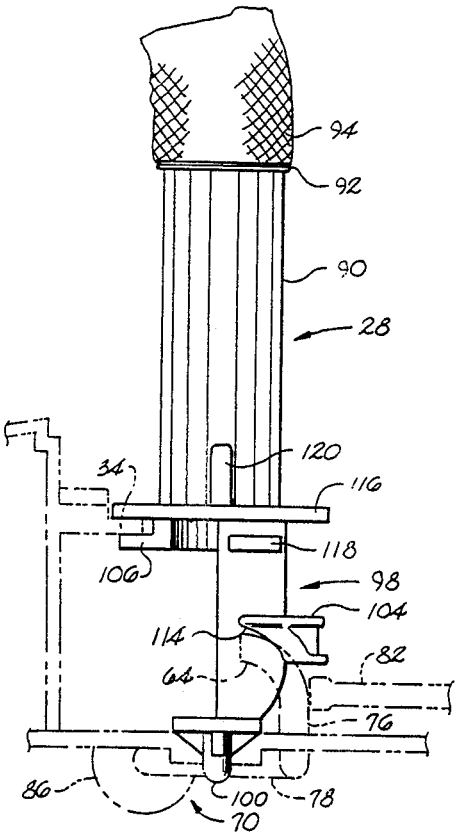
FIGS. 6 and 7 illustrate in solid line generally side elevational views of the exemplary adaptor of FIG. 5, and the interaction thereof with actuatable mechanisms of a vacuum cleaner (illustrated in dotted line) as relates to lift means in accordance with the present invention (with the rotational orientation of the adaptor being advanced 90° in FIG. 7 relative that of FIG. 6)
Figure 7:
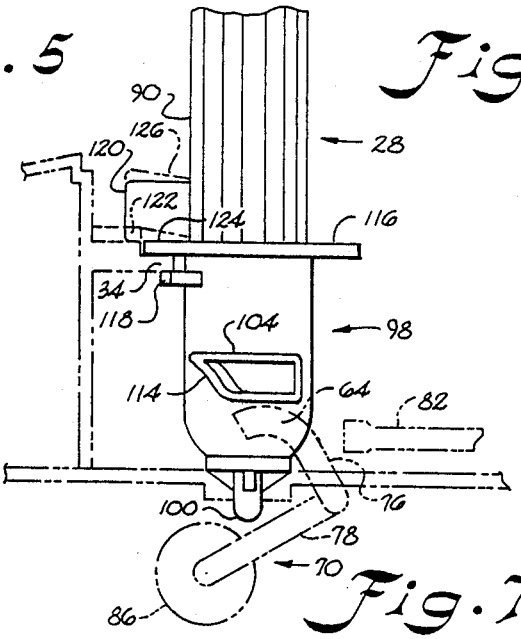

In addition to the respective actuation features associated with camming structure of the present adaptor means, the cylindrical body thereof may further include a pair of axially spaced members 116 and 118 situated at least partially about cylindrical body 90 for axially securing same in the vacuum cleaner auxiliary suction port, by capturing a surface of such vacuum cleaner between the two axially spaced members. Surfaces 32 and 34 of port opening 30 may be utilized (i.e., captured) in such manner, as illustrated in FIGS. 4, 6, and 7. For example, axially spaced member 116 may preferably comprise an annular collar about the full circumference of cylindrical body 90, and its opposing spaced member may comprise one of the camming structures such as 106 (see FIGS. 4 and 6), or another member such as 118 (see FIG. 7) provided for such axial capturing purpose.

Various other features may also be alternatively practiced in conjunction with adaptor means 88 for further facilitating operations therewith. For example, a thumb or finger grip 120 may be provided axially outward on one circumferential location of cylindrical body 90 to assist manipulation of such cylindrical body. In particular, such finger grip 120 may slightly flex over and engage a detent 122 on main chassis 12 as adaptor means 88 is rotated for actuation (e.g., clockwise) to provide relatively positive engagement of adaptor means 88 in an auxiliary suction port of vacuum cleaner 10. A narrow slot 124 may be preferably defined between annular collar 116 and thumb grip 120 to permit such slight flexure of thumb grip 120 (see dotted line illustration 126 of FIG. 7) over detent 122. Of course, during reverse rotation (e.g., counter-clockwise) of adaptor means 88, grip 120 again flexes over detent 122 to permit disengagement of the adaptor from the cleaner, as well as reverse actuation of first member 56 and second member 64 and their respective diverting and lifting operations.

While the foregoing discusses particular specific features and mechanisms in accordance with the present invention, the following description more broadly summarizes the operational advantages and benefits flowing from the practice of various embodiments in accordance with the present invention.

An improved adaptor means, such as represented by the exemplary embodiment of present FIG. 5, may be provided for operational association of an auxiliary cleaning attachment, such as a flexible hose or the like, with an auxiliary suction port of a vacuum cleaner. Preferably, such operative association takes the form of insertion and relative rotation of such adaptor means within the vacuum cleaner port, or some equivalent relative motion therebetween, for causing camming structure or other equivalent structures associated with the adaptor means to actuate one or more internal structures or mechanisms of the vacuum cleaner. Such operative association automatically adapts the vacuum cleaner for auxiliary cleaning operation by virtue of the actuated response or responses to association of the adaptor and its corresponding auxiliary cleaning attachments. Removal of the adaptor from the cleaner preferably reverses such actuations to return the cleaner to a condition or status ready for main cleaning operations therewith.

Figure 11:
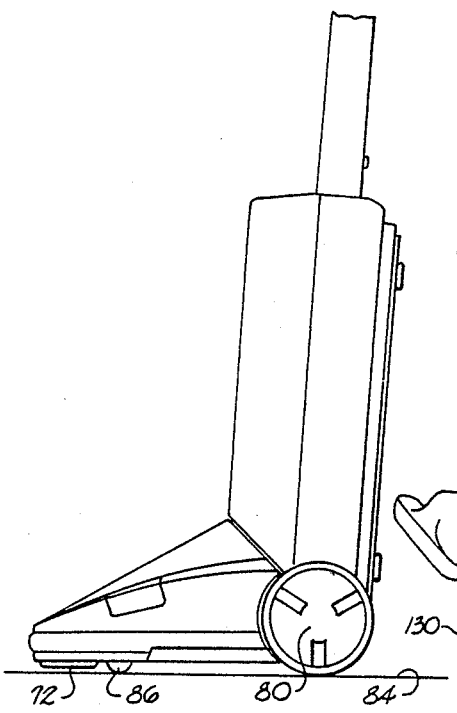
FIGS. 11 and 12 generally illustrate the vacuum cleaner of present FIGS. 1 and 10 respectively before and after association of an auxiliary cleaning attachment adaptor (and corresponding attachment) therewith.
Figure 12:
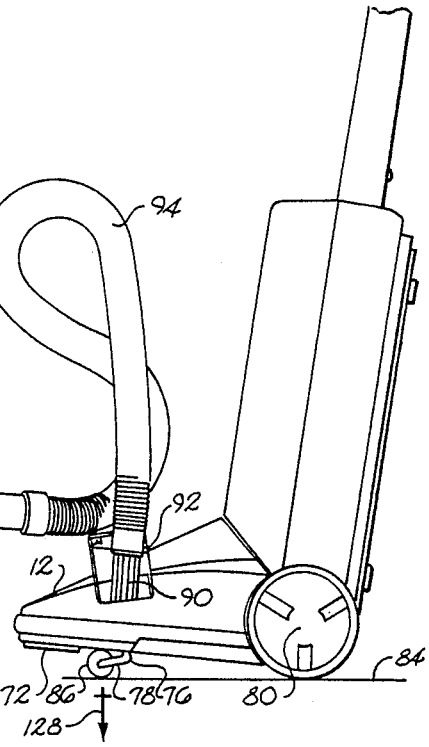

As represented by the progressive comparisons of FIGS. 3 and 4, and of FIGS. 8 and 9, respectively, operative association of an improved adaptor in accordance with the present invention with a vacuum cleaner constructed in accordance with the present invention may facilitate actuation of diverter means for diverting suction flow through such adaptor into its corresponding auxiliary cleaning attachments. Alternative embodiments of the present invention may respond to such operative association of an adaptor means for actuation of another feature instead of such diverter means, or in further combination therewith. Progressive comparison of present FIGS. 11 and 12 illustrate the lift means actuation which may advantageously be obtained with operative association of the auxiliary cleaning attachments with a vacuum cleaner system provided in accordance with the present invention. For example, as the adaptor is inserted and rotated, lift bar 76 is driven downward in the direction of arrow 128, while the forward portion of chassis 12 responds by moving upward in the direction of arrow 130 as the chassis pivots about rearward axis 80. Different mechanisms may be practiced in the alternative for lifting the cleaner chassis or otherwise disengaging the rotating bar brush, responsive to insertion of the adaptor means.

Numerous equivalents and variations will be evident to those of ordinary skill in the art for the features and means represented and disclosed in conjunction with the foregoing exemplary embodiments of this invention. All such variations are intended to come within the spirit and scope of this invention by virtue of present reference thereto. Furthermore, the language utilized above in connection with description of the accompanying figures is intended by way of description and example only, and not as limiting to the present invention, which is further defined by the appended claims.

What is claimed is:

1. A vacuum cleaner adapted for use with auxiliary cleaning attachments, comprising a main chassis having a main suction nozzle, a dirt collecting bag, a vacuum channel for interconnecting said main suction nozzle with said dirt collecting bag, suction motor means for providing suction force in said vacuum channel and directed toward said dirt collecting bag, an auxiliary suction port adapted for receipt and securement therein of an auxiliary cleaning attachment, and diverter means adjacent said vacuum channel and operatively associated with said auxiliary suction port for automatically diverting suction force provided in said vacuum channel from said main suction nozzle to said auxiliary suction port upon receipt and securement of an auxiliary cleaning attachment therein, said diverter means comprising a pivoting door received within said main chassis and mounted for selected pivoting thereof into said vacuum channel, said pivoting door having a relatively rigid finger member projecting therefrom for selected pivoting actuation of said door, said auxiliary suction port including an opening of predetermined circumferential configuration formed through said main chassis for receiving, guiding, and permitting subsequent rotation of, an auxiliary cleaning attachment therein, with such attachment being guided so as to ensure actuation of said diverter means therewith upon such subsequent rotation, whereby said vacuum cleaner is adapted to automatically apply suction force to an auxiliary cleaning attachment inserted therein instead of said main vacuum nozzle thereof for auxiliary cleaning with such attachment.

2. A vacuum cleaner as in claim 1, wherein said pivoting door is received on a post defined within said main chassis, and further includes spring-loading thereof relative to said post for being biased into a closed position thereof, in a direction generally towards said auxiliary suction port, actuation of said projecting finger member selectively overcoming such biasing, and further wherein said pivoting door in such closed position thereof forms a common sidewall with said vacuum channel.

3. A vacuum cleaner as in claim 2, further comprising a pivoting access cover mounted on said main chassis for removably covering said auxiliary suction port, said access cover further including locking means for automatically locking said pivoting door in said closed position thereof whenever said access cover is closed for covering said auxiliary suction port, wherein opening of said access cover permits receipt and securement of an auxiliary cleaning attachment in said auxiliary suction port.

4. A vacuum cleaner as in claim 3, wherein said locking means includes a projecting wing on an interior surface of said access cover, said wing engaging said pivoting door projecting finger member whenever said access cover is closed so as to lock said pivoting door in said closed position thereof to prevent diverting of suction force provided in said vacuum channel from said main suction nozzle to said auxiliary suction port.

5. A vacuum cleaner as in claim 4, wherein said access cover is mounted relative said main chassis with a hinge capable of pivoting movement up to about 180° so as to open an amount adequate to move said projecting wing thereof fully out of the region located above said auxiliary suction port, to permit receipt of an auxiliary cleaning attachment therein.

6. A vacuum cleaner as in claim 1, wherein said main chassis further defines an annular opening axially beneath said auxiliary suction port opening, for receipt and subsequent rotation of a forward axial end of an auxiliary attachment therein.

7. A vacuum cleaner as in claim 1, wherein said main chassis includes at least one generally planar lower side, with said main suction nozzle being defined in such chassis lower side, and wherein said vacuum cleaner further comprises:

a rotatably driven bar brush journaled in said main suction nozzle;

wheel means mounted on said chassis for supporting same spaced from said main suction nozzle thereof;

lift means situated intermediate said main suction nozzle and said wheel means on said chassis lower side for controllably lifting said main suction nozzle, upon selected actuation of said lift means, by pivoting said chassis upward about said wheel means thereof;

and lift actuation means operatively associated with said lift means and said auxiliary suction port for responding to receipt and securement of an auxiliary cleaning attachment therein by actuating said lift means for said lifting operation thereof, whereby said vacuum cleaner is adapted to automatically lift said main suction nozzle and said driven bar brush journaled therein relative a work surface upon which said vacuum cleaner lower side is supported whenever an auxiliary cleaning attachment for auxiliary cleaning with such attachment is inserted therein.

8. An improved adaptor for permitting use of an auxiliary cleaning attachment with a vacuum cleaner, comprising a generally hollow, cylindrical body, having a first substantially open end thereof adapted for operative securement of an auxiliary cleaning attachment thereto, and a second open end opposite from said first end thereof and adapted for operative securement in an auxiliary suction port of a vacuum cleaner, said second end including an extended flange adapted for guided insertion thereof into said port and subsequent rotation of said adaptor about its longitudinal axis, said extended flange further defining a pair of respective camming means thereon for adapting said vacuum cleaner for auxiliary cleaning operation upon insertion and rotation of said adaptor therein, so as to both divert suction force of the vacuum cleaner through said adaptor hollow body to an auxiliary cleaning attachment secured to said first end thereof, and to lift a main suction nozzle and rotating beater bar brush of the vacuum cleaner from a support surface thereunder, respectively, whereby the vacuum cleaner is automatically converted for auxiliary cleaning operations with auxiliary cleaning attachments upon insertion and rotation of said improved adaptor therein.

9. An improved adaptor as in claim 8, wherein said extended flange is generally semi-circular in construction, and defines a rotation tip on a free, axial end thereof, said rotation tip being co-axially aligned with the rotation axis of said cylindrical body.

10. An improved adaptor as in claim 8, wherein said pair of camming means provide forces respectively outward and longitudinal to the rotation axis of said cylindrical body as such body is rotated.

11. An improved adaptor as in claim 8, wherein said cylindrical body further includes a pair of axially spaced members situated at least partially about said cylindrical body for axial securement of same in a vacuum cleaner auxiliary suction port with a surface of such vacuum cleaner captured between said two axially spaced members.

12. An improved adaptor as in claim 11 wherein:

one of said axially spaced members comprises an annular collar about the full circumference of said cylindrical body; and said body further includes a finger grip projecting outwardly from the circumference thereof, said finger grip further engaging a detent of the vacuum cleaner upon rotation of the improved adaptor relative thereto, for tending to lock the improved adaptor in its rotated position.

13. An improved adaptor as in claim 11, wherein one of said axially spaced members includes a circumferentially outward edge thereof which progressively extends further from the circumference of said cylindrical body for defining one of said camming means thereof.

14. An improved adaptor as in claim 8, wherein said adaptor is of relatively rigid construction comprised of high impact plastic materials.

15. A vacuum cleaner system for alternately operating for main or auxiliary cleaning by supplying vacuuming power to a main vacuum nozzle thereof or to an auxiliary attachment secured thereto, respectively, comprising:

a main chassis including a head portion having for main cleaning operation a main vacuum nozzle on a lower side thereof, and including a body portion having a dirt collecting bag;

a rotating bar brush journaled in said main vacuum nozzle;

vacuum channel means, defined within said chassis, for interconnecting said main vacuum nozzle with said dirt collecting bag;

suction means, carried on said chassis, for providing suction force within said vacuum channel means directed towards said dirt collecting bag;

an auxiliary suction portion in said chassis through an outer wall thereof, for providing auxiliary access to said vacuum channel means;

an access door, support on said chassis outer wall, for selectively covering said auxiliary suction port;

lift means, operatively associated with said auxiliary suction port and said chassis lower side, and responsive to selected actuation thereof for lifting said bar brush away from a floor surface on which said chassis lower side is support by an amount adequate to fully disengaged said rotating bar brush from such floor surface;

an auxiliary attachment for auxiliary cleaning operation therewith; and adaptor means, mounted on one end of said auxiliary attachment, for selected securement thereof in said auxiliary suction port uncovered by said access door for operatively interconnecting said auxiliary attachment with said vacuum channel means so as to contact vacuum force through such auxiliary attachment for auxiliary cleaning therewith remote from said main vacuum nozzle, and further for actuating said lift means upon securement of said adaptor means in said auxiliary suction port;

said lift means comprising an angled lift bar, said lift bar being relatively rigid, pivotally mounted on said chassis lower side, and further including an extended actuation arm which extends generally form said chassis lower side into the vicinity of said auxiliary suction port for actuation thereof upon securement of said adaptor means in said port, such actuation pivoting said lift means so as to extend an angled portion thereof downwardly from said chassis lower side resulting in said lifting operation of said lift means;

said adaptor means comprising a generally cylindrical, hollow body member with camming structure defined on an end thereof to be inserted and subsequently rotated in said auxiliary suction port for securement therein, and further wherein such subsequent rotation results in actuation of said lift means extended actuation arm by said camming structure;

whereby said vacuum cleaner system is automatically converted for auxiliary cleaning operation upon association of an auxiliary attachment with said main chassis thereof by said lifting and resulting floor surface disengagement of said rotating bar brush.

16. A vacuum cleaner system as in claim 15, wherein:

actuation force exerted with said camming structure upon said body member subsequent rotation is in a direction generally parallel to the rotational axis of said adaptor means, which adaptor means further includes an axial guide end having a rotational guide element in co-axial alignment with the rotational axis of said adaptor means; and further wherein said main chassis defines a rotation guidance opening in said chassis beneath said auxiliary suction port thereof, adapted for receipt of said adaptor means rotational guide element therein for guided axial rotation of said adaptor means within said auxiliary suction port.

17. A vacuum cleaner system for alternately operating for main or auxiliary cleaning by supplying vacuuming power to a main vacuum nozzle thereof or to an auxiliary attachment secured thereto, respectively, comprising:

a main chassis including a head portion having for main cleaning operation a main vacuum nozzle on a lower side thereof, and including a body portion having a dirt collecting bag;

vacuum channel means, defined within said chassis, for interconnecting said main vacuum nozzle with said dirt collecting bag;

suction means, carried on said chassis, for providing suction force within said vacuum channel means directed towards said dirt collecting bag;

an auxiliary suction port defined in said chassis through an outer wall thereof, for providing auxiliary access to said vacuum channel means;

an access door supported on said chassis outer wall, for selectively covering said auxiliary suction port;

diverter means, defined on said main chassis and operatively associated with said auxiliary suction port and said vacuum channel means thereof, and responsive to selected actuation thereof for diverting suction force within said vacuum channel means from said main vacuum nozzle to said auxiliary suction port;

an auxiliary attachment for auxiliary cleaning operation therewith; and adaptor means, mounted on one end of said auxiliary attachment, for selected securement thereof in said auxiliary suction port uncovered by said access door, for operatively interconnecting said auxiliary attachment with said vacuum channel means so as to conduct vacuum force through such auxiliary attachment for auxiliary cleaning therewith remote from said main vacuum nozzle, and further for actuating said auxiliary suction port;

said diverter means including a pivoting door received within said main chassis and mounted therein for selected pivoting thereof into said vacuum channel means, said pivoting door including a relatively rigid finger member projecting therefrom into the vicinity of said auxiliary suction port for selected pivoting actuation of said pivoting door upon securement of said adaptor means in said port, and wherein said pivoting door includes spring-loading thereof so as to be biased into a closed position, actuation of said projecting finger selectively moving said pivoting door into an open position thereof for said diverting operation of said diverter means;

said adaptor means including a generally cylindrical, hollow body member of relatively rigid material, having a free end thereof adapted for being received and subsequently rotated in said auxiliary suction port, said free end including camming structure thereof for engaging and actuating said projecting finger member of said pivoting door during such subsequent rotation of said adaptor means;

whereby said vacuum cleaner system is automatically converted for auxiliary cleaning operation upon association of an auxiliary attachment with said main chassis thereof by said diversion of said suction force from said main vacuum nozzle to said auxiliary attachment.

18. A vacuum cleaner system as in claim 17, wherein:

actuation force exerted with said camming structure upon said body member subsequent rotation is in a direction generally perpendicular to the rotational axis of said adaptor means, which adaptor means further includes an axial guide end having a rotational guide element in co-axial alignment with the rotational axis of said adaptor means; and further wherein said main chassis defines a rotation guidance opening in said chassis beneath said auxiliary suction port thereof, adapted for receipt of said adaptor means rotational guide element therein for guided axial rotation of said adaptor means within said auxiliary suction port.

19. A vacuum cleaner system for alternately operating for main or auxiliary cleaning by supplying vacuuming power to a main vacuum nozzle thereof or to an auxiliary attachment secured thereto, respectively, comprising:

a main chassis including a head portion having for main cleaning operation a main vacuum nozzle on a lower side thereof, and including a body portion having a dirt collecting bag;

a rotating bar brush journaled in said main vacuum nozzle;

vacuum channel means, defined within said chassis, for interconnecting said main vacuum nozzle with said dirt collecting bag;

suction means, carried on said chassis, for providing suction force within said vacuum channel means directed toward said dirt collecting bag;

an auxiliary suction port defined in said chassis through an outer wall thereof, for providing auxiliary access to said vacuum channel means;

an access door, supported on said chassis outer wall, for selectively covering said auxiliary suction port;

lift means, operatively associated with said auxiliary suction port and said chassis lower side, and responsive to selected actuation thereof for lifting said bar brush away from a floor surface on which said chassis lower side is supported by an amount adequate to fully disengage said rotating bar brush from such floor surface;

diverter means, defined on said main chassis and operatively associated with said auxiliary suction port and said vacuum channel means thereof, and responsive to selected actuation thereof for diverting suction force within said vacuum channel means from said main vacuum nozzle to said auxiliary suction port;

an auxiliary attachment for auxiliary cleaning operation therewith; and adaptor means, mounted on one end of said auxiliary attachment, for selected securement thereof in said auxiliary suction port uncovered by said access door for operatively interconnecting said auxiliary attachment with said vacuum channel means so as to conduct vacuum force through such auxiliary attachment for auxiliary cleaning therewith remote from said main vacuum nozzle, and further for actuating said lift means and said diverted means, respectively, upon securement of said adaptor means in said auxiliary suction port;

said lift means comprising an angled lift bar, said lift bar being relatively rigid, pivotally mounted on said chassis lower side, and further including an extended actuation arm which extends generally from said chassis lower side into the vicinity of said auxiliary suction port for actuation thereof upon securement of said adaptor means in said port, such actuation pivoting said lift means so as to extend an angled portion thereof downwardly from said chassis lower side resulting in said lifting operation of said lift means;

said diverter means comprising a pivoting door received within said main chassis and mounted therein for selected pivoting thereof into said vacuum channel means, said pivoting door including a relatively rigid finger member projecting therefrom into the vicinity of said auxiliary suction port for selected pivoting actuation of said pivoting door upon securement of said adaptor means in said port, and wherein said pivoting door includes spring-loading thereof so as to be biased into a closed position, actuation of said projecting finger selectively moving said pivoting door into an open position thereof for said diverting operation of said diverter means;

said adaptor means comprising a generally cylindrical, hollow body member with camming structure defined on an end thereof to be inserted and subsequently rotated in said auxiliary suction port for securement therein, and further wherein such subsequent rotation results in actuation by said camming structure of said lift means extended actuation arm and said pivoting door projecting finger member;

whereby said vacuum cleaner system is automatically converted for auxiliary cleaning operation upon association of an auxiliary attachment with said main chassis thereof by said lifting and resulting floor surface disengagement of said rotating bar brush and by said diversion of said suction force from said main vacuum nozzle to said auxiliary attachment.

20. A vacuum cleaner system as in claim 19, wherein:

actuation force exerted with said camming structure during said body member subsequent rotation is provided both in a direction generally parallel to the rotational axis of said adaptor means and generally perpendicular to such axis for respective actuation of said lift means and said diverter means, said adaptor means further including an axial guide end having a rotational guide element in co-axial alignment with the rotational axis of said adaptor means; and further wherein said main chassis defines a rotation guidance opening in said chassis beneath said auxiliary suction port thereof, adapted for receipt of said adaptor means rotational guide element therein for guided axial rotation of said adaptor means within said auxiliary suction port.

21. An improved vacuum cleaner system, generally of an upright-type for floor surface main vacuuming, and automatically adapting for auxiliary vacuuming upon association of an auxiliary vacuuming hose therewith, comprising:

a mobile chassis having a main intake opening defined on a lower surface thereof, collection means for receipt of vacuumed materials, and a passageway for interconnecting said main intake opening with said collection means;

suction means, carried on said mobile chassis, for creating suction force within said passageway directed towards said collection means;

a rotating beater bar brush journaled in said main intake opening so as to face said lower surface for interaction with a floor surface to be vacuumed and upon which said mobile chassis is supported, such interaction resulting in agitation of such floor surface for improved vacuuming thereof;

a pair of wheels rotatably mounted on said chassis for mobile support of same relative a floor surface to be vacuumed;

a lift axle, movably received on said chassis lower surface intermediate said main intake opening and said wheels, for controlled movement relative such lower surface, which movement pivots said chassis relative the floor surface upon which it is supported about an axis defined by said pair of wheels so as to control the relative height of said rotating beater bar brush above, and interaction with, such floor surface;

an auxiliary suction portal defined by a port through an external wall of said chassis and terminating in an internal chamber adjacent said passageway and defined within said chassis at least in part by a movable sidewall shared in common with said passageway;

a diverter door defining said movable common sidewall, said diverter door being movable between a defined closed position which conducts suction force within said passageway to said main intake opening for vacuuming the floor surface upon which said chassis is supported, and a defined opened position which diverts suction force within said passageway to said auxiliary suction portal instead of said main intake opening for auxiliary attachment vacuuming, said diverter door being spring-loaded for biasing to said closed position thereof;

a first relatively rigid extension finger, fixedly attached to said diverter door and projecting therefrom at least partially into said auxiliary suction portal internal chamber, selected movement of said first finger actuating said diverter door so as to overcome said spring-biasing thereof for movement of said diverter door to its opened position;

a second relatively rigid extension finger, fixedly attached to said lift axle and projecting therefrom at least partially into said auxiliary suction portal internal chamber, selected movement of said second finger actuating said lift axle so as to raise the height of said rotating beater bar brush above the floor surface an amount adequate to preclude interaction between said rotating brush and such floor surface;

a generally rigid, hollow, cylindrical hose adaptor having opposing first and second ends, with an auxiliary vacuuming hose attached to said first end thereof, and with respective first and second camming means associated with said second end thereof;

wherein said hose adaptor second end is adapted for insertion into said auxiliary suction portal internal chamber through said chassis external wall port, and is further adapted for subsequent axial rotation of said hose adaptor, whereby upon such rotation said first and second camming means respectively engage and selectively move said first and second fingers projecting into said internal chamber so as to automatically divert suction force within said passageway into said auxiliary vacuuming hose through said hollow hose adaptor while automatically raising said rotating brush from a floor surface by an amount adequate for free rotation of such brush during auxiliary vacuuming.

* * * * *